US006575432B1

(12) United States Patent
Oronoz

(10) Patent No.: US 6,575,432 B1
(45) Date of Patent: Jun. 10, 2003

(54) JACK FOR VEHICLES

(75) Inventor: Rafael Alvarez Oronoz, Amorebieta (ES)

(73) Assignee: Batz, S., Coop., Igorre (ES)

( * ) Notice: Subject to any disclaimer, the term of this patent is extended or adjusted under 35 U.S.C. 154(b) by 0 days.

(21) Appl. No.: 09/830,699

(22) PCT Filed: Aug. 22, 2000

(86) PCT No.: PCT/ES00/00330

§ 371 (c)(1),
(2), (4) Date: Nov. 20, 2001

(87) PCT Pub. No.: WO01/16014

PCT Pub. Date: Mar. 8, 2001

(30) Foreign Application Priority Data

Aug. 30, 2000 (ES) ..... 9901956

(51) Int. Cl.[7] ..... B66F 3/08
(52) U.S. Cl. ..... 254/126
(58) Field of Search ..... 254/126, 103, 254/122, DIG. 2, DIG. 3, 133 R, 124

(56) References Cited

U.S. PATENT DOCUMENTS 4,366,948 A * 1/1983 Hafner ..... 254/126
5,356,117 A * 10/1994 Engel ..... 254/126
5,782,457 A * 7/1998 Arguelles ..... 254/126
5,950,990 A * 9/1999 Castillo ..... 254/126
6,022,001 A * 2/2000 Palacio et al. ..... 254/126

FOREIGN PATENT DOCUMENTS

| | | |
|---|---|---|
| EP | 0 320 613 B1 | 6/1989 |
| EP | 0 340 551 B1 | 11/1989 |
| EP | 885834 A | 12/1998 |
| ES | 1010176 U | 12/1989 |
| ES | 2026626 T | 5/1992 |
| GB | 2345900 A | 7/2000 |
| WO | WO 9929615 A | 6/1999 |

* cited by examiner

*Primary Examiner*—Lee D. Wilson
(74) *Attorney, Agent, or Firm*—Browdy and Neimark, P.L.L.C.

(57) ABSTRACT

A vehicle jack with a reinforced nut and a device to eliminate noise when the jack is in the folded position. The nut is composed of two bodies (5, 5'), outer and inner, respectively, which have mutual additional surface contact point (6, 20) and (11, 17) and the reinforcing part has some lugs (34) that engage the more forward or front end of the screw spindle.

24 Claims, 4 Drawing Sheets

JACK FOR VEHICLES

The present application is the national stage under 35 U.S.C. §371 of international application PCT/ES00/00330, filed Aug. 22, 2000, which designated the United States, and which application was not published in the English language.

BACKGROUND OF THE INVENTION

1. Technical Field of the Invention

This invention relates to a jack for raising vehicles, of the type known as "Y" jacks, consisting of a support leg equipped with a foot and a vehicle support arm that turns on the support leg, in which the two upper ends of the support leg and the vehicle support arm are linked by means of a screw spindle that connects a nut in the support leg and a cross member in the vehicle support arm, with this screw spindle being turned by means of a winding handle. The movements of the screw spindle in one turning direction or the other cause the upper end of the vehicle support arm to be raised or lowered, so that by incorporating a vehicle support plate to bear the weight of the vehicle bodywork, the vehicle support arm arises or lowers the vehicle.

2. Prior Art

In certain types of jacks, made of aluminium, the vehicle support arm includes an auxiliary or reinforcing part at its upper end, which is housed inside the said vehicle support arm, as described in the publication EP. A. 0887303. In these jacks, the end of the screw spindle reaches close to the reinforcing part, more specifically through the head of the screw spindle or its riveted end portion, causing noise when the jack is in its folded position due to vibration from the vehicle being transmitted to the parts in question.

Also known through U.S. Pat. No. 1,901,915 is the existence of a nut, through which a screw spindle passes, which is included inside a U-shaped metal part which is secured to the arms of the jack.

Also known through WO. A. 99/29615 is a "Y" type jack that includes a nut housed in the interior of a U-shaped metal part, in which the metal part is provided with some cylindrical necks that are housed in holes in the wings of the cross section of the vehicle support arm. The nut is prepared so that it does not turn inside the metal part.

In these last two references, the screw spindle passes through the nut and a hole in the base of the U-shaped metal part, so that when the jack is bearing a load, the excessive concentration of stresses takes place on the nut and against the base of the metal part, causing the nut to become unusable.

OBJECT AND SUMMARY OF THE INVENTION

One object of the invention is to provide a vehicle jack which is equipped with a unit composed of a nut and a metal part that prevents the concentration of stresses on the nut and on the metal part, thus providing greater working life to the jack.

Another object of the invention is to provide a vehicle jack with a reinforcing part in the interior of the vehicle support arm, which does not create any kind of noise when the jack is in its folded position.

In order to achieve these objectives, the invention claims a jack provided with a nut and a U-shaped metal part through which the screw threaded spindle passes, in which the outer U-shaped body and the inner body that forms the nut itself are provided with surface areas that make contact with each other, so that when the jack is bearing a load, the incidence of the nut on the outer body is perfectly distributed.

In particular, the outer metal part is equipped with two longitudinal reinforcements that protrude out from the base of the part and extend parallel to each other towards the front opening in the said outer part. These two side reinforcement provide some vertical surface edges at their free ends which are transversally aligned and contained in the same plane.

The said surfaces form two front edges starting from the front opening in the outer U-shaped metal part.

On the other hand, the ends of the U-shaped wings of this outer part are each provided with inclined areas in a converging direction towards each other and towards the central plane of the part, in which some wide vertically aligned cavities are made. These cavities in turn each form surface areas, vertically aligned, at the bottom of the said cavities and starting from the entrance to the U-shaped body.

This outer metal part also includes two necks protruding from its wings, for insertion into the wings of the vehicle support arm, the same as in WO. A. 99/29615, as well as a hole in the centre of the base to allow the passage of the threaded screw spindle.

Meanwhile, the inner part or the one which is provided with a screw threaded hole for the insertion of the screw spindle, has some lateral projections made on the same side as the side reinforcements of the outer part, with these projections forming rear surface edges which in assembly make contact with the corresponding ones of the above mentioned reinforcements.

In the same way, this part or inner body is also provided with another two carried out in a perpendicular plane to that of the mentioned lateral projections and with these front projections vertically aligned.

The front of this inner part on side nearer the winding handle that operates the screw spindle is made with a protruding trunco-conical area.

In the assembly of the inner body into the outer one, the following circumstances take place:

The converging ends of the wings of the outer body present a certain difficult for the entry of the inner body, so that once this is housed, these ends act like clips by helping to keep the said inner body in its position.

The side surface edges of both the inner and outer bodies that provide the side reinforcements and the projections on each one remain in frontal contact.

The vertical projections on the inner body are housed in the cavities at the ends of the wings in the outer body, with surface contact also taking place between the rear sides of these projections and these cavities.

It is observed, therefore, that on the inner body being housed inside the outer one, the contact surface is increased in a longitudinal direction between both by a considerable amount, so that when the jack is bearing a load, the tendency of the inner body towards the base of the exterior one does not create any kind of overload that might disable the inner body. This body that forms the nut therefore remains preserved in its area of greater commitment of excessive concentration of stresses.

On the other hand, the inner reinforcing part housed in the interior of the vehicle support arm of the jack is provided, at its end nearer to the screw spindle, with two inclined lugs that converge towards the interior of the U-shape that forms this auxiliary part. The end or riveted portion of the screw spindle makes contact with these lugs when the jack is in its folded position, so that on forcing the winding handle of the screw spindle in order to carry our folding of the jack, pressure is placed on the said lugs, which might become deformed by the pressure exerted, although always maintaining the appropriate contact.

Therefore, this contact between the two lugs and the riveted or most forward portion of the screw spindle is ensured in its stored condition, with which any kind of unwanted noise is avoided in the jack folded position.

BRIEF DESCRIPTION OF THE DRAWINGS

The object of the invention is shown on the accompanying sheets of drawings, and is represented, without any kind of restrictive nature, as follows.

DETAILED DESCRIPTION OF THE PREFERRED EMBODIMENT(S) OF THE INVENTION

Figure 1:
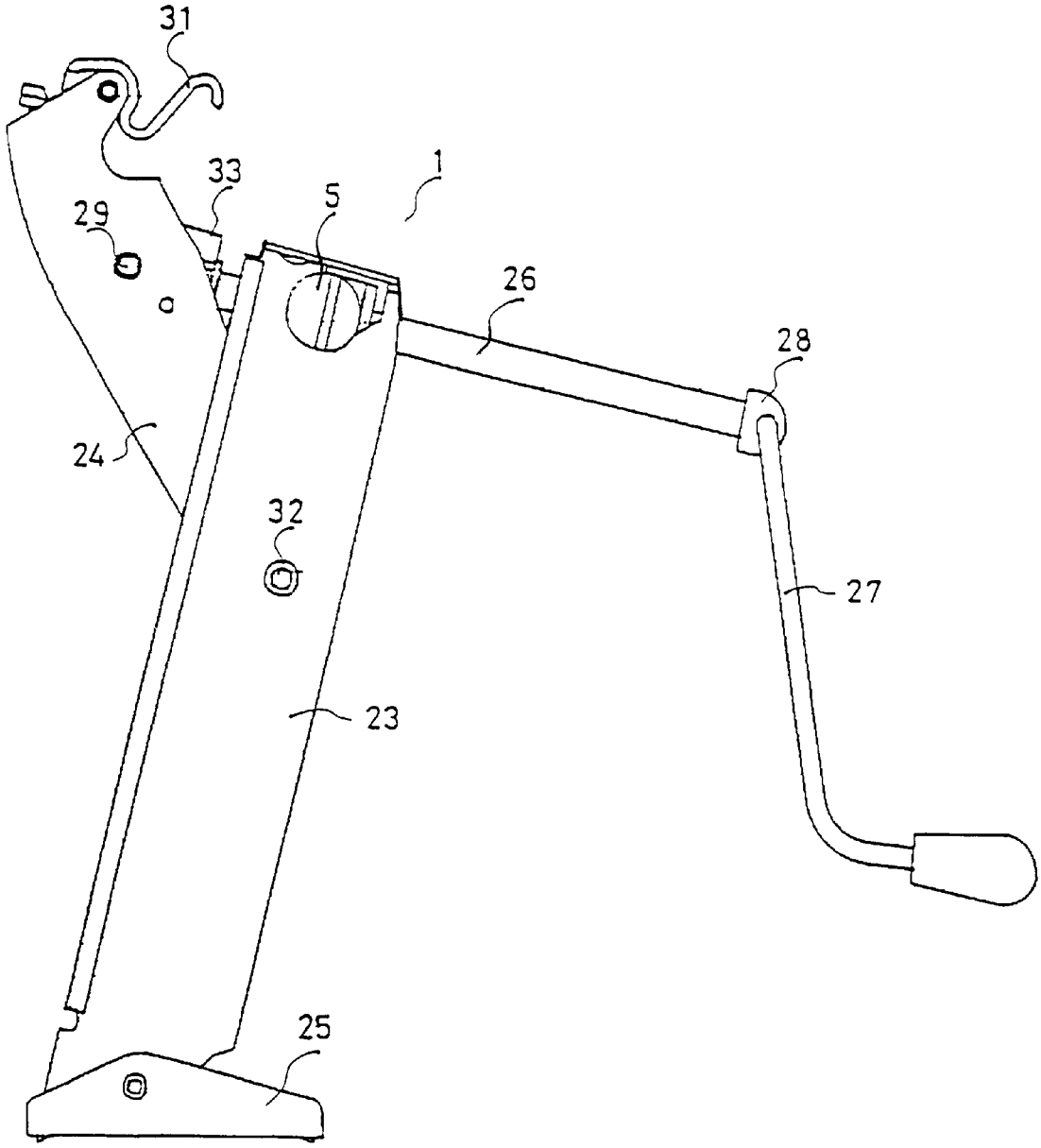
FIG. 1 is a representation of a "Y" jack to which the invention is applied.

With regard to FIG. 1, we can appreciate a jack (1) with the support leg (23), the support foot (25) and the vehicle support arm (24) that pivots at (32) on the support leg (23). Both are connected at the top by means of the screw spindle (26) operated by the winding handle (27) that turns at the end (28) of the screw spindle.

The screw spindle (26) passes through the nut (5) in the support leg (23) and continues towards the vehicle support arm (24) in which the cross member (33) is situated and is fixed to the said arm.

The actions of the screw spindle in one direction or the other cause the raising or the lowering of the leg (23) and the arm (24) and consequently the raising or lowering of the vehicle support plate (31) that receives the lower edge of the vehicle body.

Figure 2:
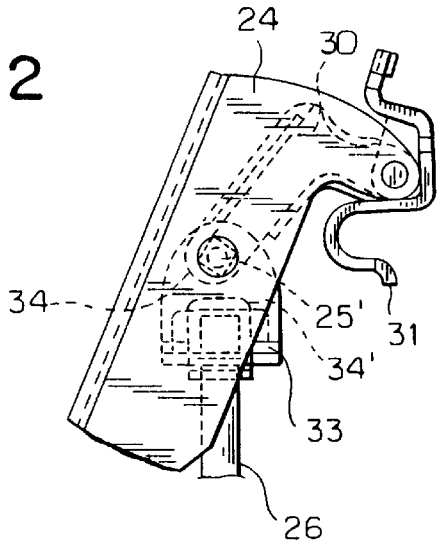
FIG. 2 is a detail of the upper end of the vehicle support arm, showing the vehicle support plate and the reinforcing part.

In FIG. 2 we can point out the reinforcing part (30) used in those cases in which the support leg (23) and the arm (24) are made of an aluminum alloy. The most forward portion (34') of the screw spindle (26), close to the cross member (33) almost reaches this reinforcing part.

Figure 9:
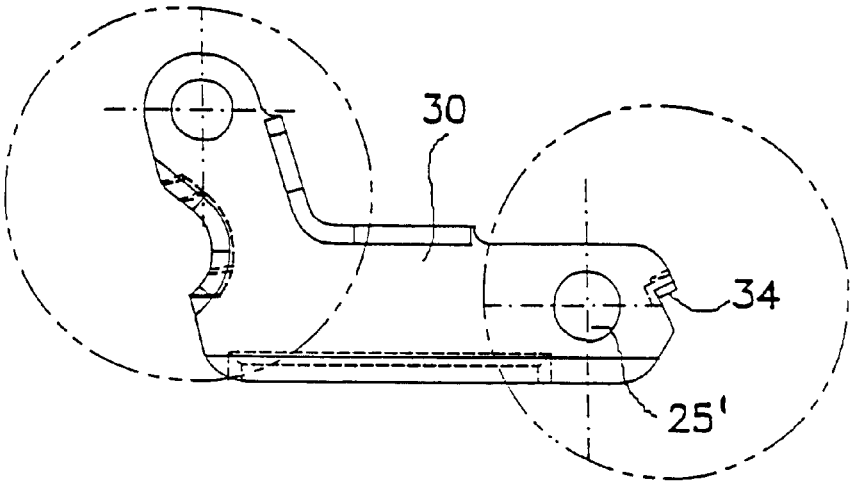
FIG. 9 is a side elevation of the reinforcing part.

This auxiliary reinforcing part (30) has an L-shaped elevation, FIG. 9, which is secured to the wings of the vehicle support arm (24), which is generally U-shaped, and is rotatably fixed at its ends (25').

Figure 10:
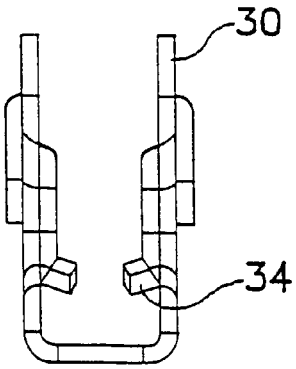
FIG. 10 is a view of FIG. 9 seen from the right.
Figure 11:
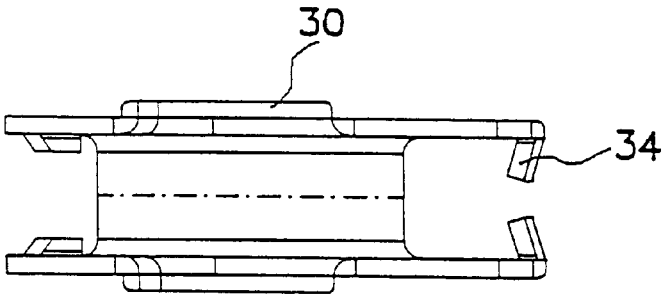
FIG. 11 is a top view of FIG. 10.

In accordance with FIGS. 9, 10 and 11, we can observe the two inclined converging lugs (34) towards the interior of the auxiliary reinforcing part (30). The end (34') of the screw spindle is supported on these lugs (34), as shown in FIG. 2, so that when the jack is folded on forcing the screw spindle in order to reach this position, perfect support of the end (34') on the lugs (34) is achieved.

In later folding operations, the adjustment is already carried out and the end (34') is perfectly received on the two lugs (34) of the auxiliary reinforcing part (30).

Figure 3:
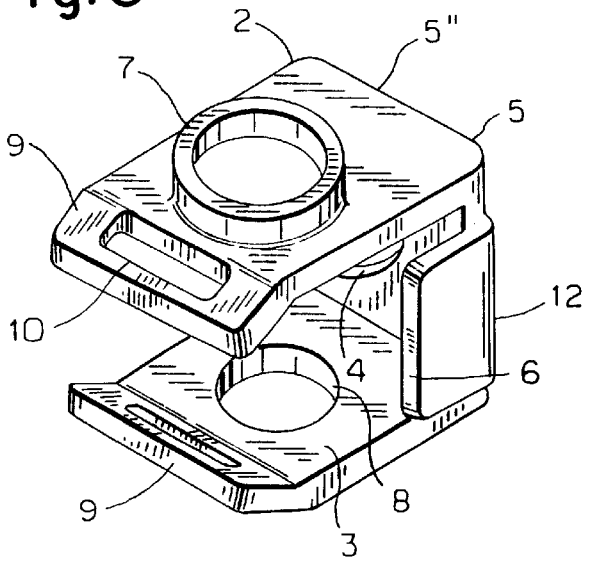
FIG. 3 is a perspective of the outer metal part that holds the plastic wharve.

With regards to FIG. 3, we can point out the outer part 5" that forms the nut (5) for the passage of the screw spindle, with its characteristic "U" shape and its two wings (2, 3) on which the protruding necks (7, 8) are made, for their insertion into the wings of the support leg (23). The base or bottom of this part includes a hole (4) for the passage of the screw spindle that passes through the inner body-plastic wharve, not shown here.

The front opening in this part will receive the inner body, which will occupy the cavity provided for it, with the opening corresponding to the position nearest to the winding handle and the base to the position farthest from this winding handle.

Figure 4:
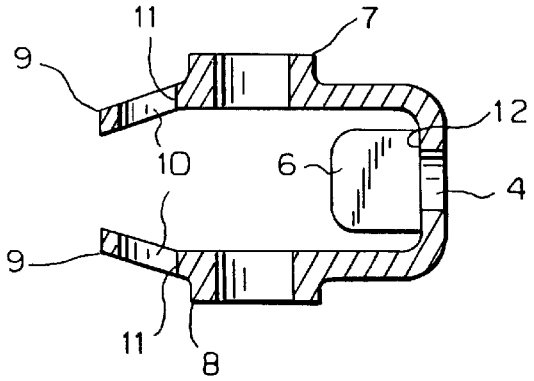
FIG. 4 is a central longitudinal cross section of FIG. 3.

We can observe in FIGS. 3 and 4 the two longitudinal reinforcements (12) that come from the base and continue in parallel planes for a certain dimension towards the opening in the part. The two reinforcements provide the surfaces (6) which are vertical and are contained in a single transversal plane.

The forward or front area of the part has the two inclined converging portions (9) in which the vertically aligned cavities (10) have been cut. These two cavities in turn provide the surfaces (11).

The surfaces (6, 9) of this outer body will be used as auxiliary support for surface ridges or ledges on the inner body-plastic wharve, in addition to the conventional one in the base in which the hole (4) is made, and the converging ends (9) will contribute to the insertion of the inner body-plastic wharve and to keeping it there once housed.

Figure 5:
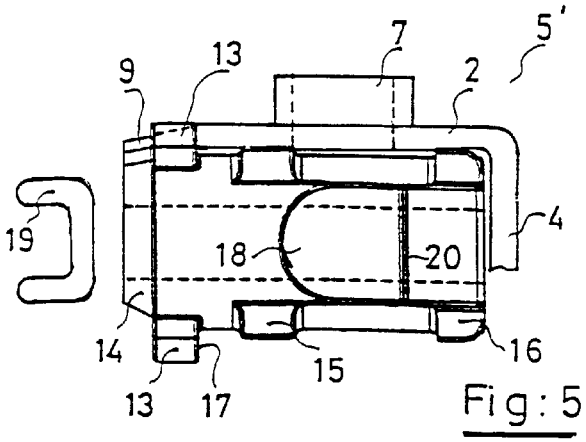
FIG. 5 represents the inner body-plastic wharve in its relationship with the outer part.
Figure 6:
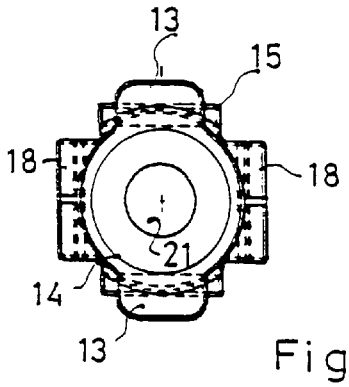
FIGS. 6, 7 and 8 represent another three view of the inner body-plastic wharve.

From the contents of FIGS. 5, 6, 7 and 8, we can observe the inner body-plastic wharve (5') of the cross member, which is equipped with the longitudinal side projections (18) that create surfaces (20) to make contact with the surfaces (6) of the outer body; the forward or front projections (13) that provide surfaces (17) to make contact with the surfaces (11) of the outer body, and the surface (22) which will become established at the base of the outer body, as can be appreciated particularly in FIG. 5, where the position of the outer part can be seen partially, drawn in a thinner line, in its relationship with the inner part.

Figure 7:
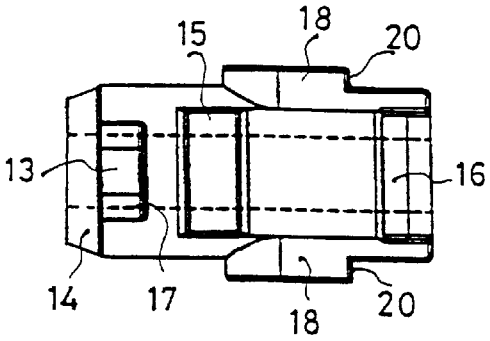
Figure 8:
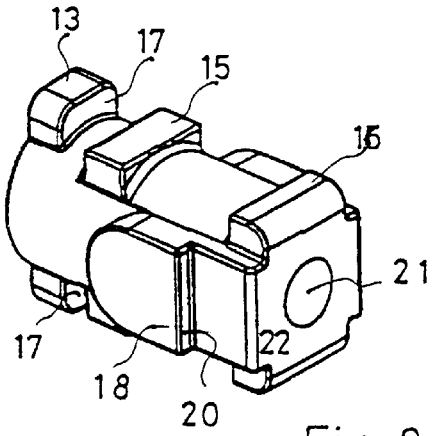

In these FIGS. 5 and 7 we can also observe the trunco-conical detail (14) of the portion of the inner part, which will be on the side nearer to the winding handle, and whose purpose is to withstand the contact with the middle part (19) coming from the connection system with the winding handle (27).

The inner body-plastic wharve (5') also has the longitudinal central hole (21) for the passage of the screw spindle and another two reinforcing ridges (15, 16), of which the one in the position (16) is rounded on the side facing towards the direction of its insertion into the outer part (5).

Both ridges (15, 16) also perform the function of preventing unwanted turning of the plastic wharve inside the outer body, a detail that was referred to in WO. A. 99/29615.

What is claimed is:

1. A vehicle jack comprising; a support leg (23) engaged on a support foot (25), a vehicle support arm (24) rotatably engaged on the support leg (23) and a screw spindle (26) operated by a winding handle (27) threaded through a nut (5) on the support leg, the screw spindle being engaged to a cross member (33) and rotatably engaged in the support leg (23), an auxiliary part (30) being coaxially engaged with the cross member (33.) and having a vehicle support plate (31) engaged to a free end thereof, wherein the auxiliary part (30) engages an end of the screw spindle when the jack is in a folded position, wherein the nut (5) comprises an outer body (5") and an interior part (5') engaged in the outer body (5") at a plurality of surface contact points, the screw spindle (26) being threadedly engaged in the interior part (5'); and wherein the outer body (5") has a U-shaped cross section, a base with a hole therethrough, two parallel wings (2, 3) projecting up respectively from opposite sides of the base which have end edges (6) parallel to the base, two parallel longitudinal reinforcements (12) projecting up, respectively from the base between the two parallel wings (2, 3), ends of the two parallel wings each having a surface (9) inclined toward a central plane of the U-shaped body, each said surface (9) having aligned cavities (10).

2. The vehicle jack as defined in claim 1, wherein the inner body (5') has two side projections (18) that form two surface areas (20), two aligned front projections (13) that each create aligned surface areas (17), and a trunco-conical reinforcement (14) protruding from an end of the inner body (5') where the aligned surface areas (17) are situated.

3. The vehicle jack as defined in claim 2, wherein the aligned cavities (10) in the outer body (5") receive, by clopping together, the two aligned projections (13) on the inner body (5'), with the aligned surface areas (17) of the inner body (5') engaged in cavities (10) of the outer body (5"), while at the same time contact is also respectively established between the two edges (6) of the outer body (5") and the two surface areas (20) of the inner body (5') and between the trunco-conical projection (13) of the inner body (5') and a forward portion (19) of the winding handle (27) when folded toward the nut (5).

4. The vehicle jack as defined in claim 1, wherein the auxiliary part (30) has at an end nearest to the screw spindle, two protruding lugs (34) converging towards an inner cavity, an end portion of the said screw spindle engaging the lugs (34) when the jack is in a folded position.

5. The vehicle jack as defined in claim 4, wherein the two lugs (34) of the auxiliary part (30) are inclined towards an interior thereof.

6. The vehicle jack as defined in claim 4, wherein the two lugs (34) are contacted by the head of the screw spindle (26) when the jack is in a folded position.

7. The vehicle jack as defined in claim 4, wherein the two lugs (34) are contacted by an end riveted portion of the screw spindle (26) when the jack is in a folded wan position.

8. The vehicle jack as defined in claim 1, wherein each said surface (9) is inclined in convergence towards each other, providing a narrowing or tapering towards an end of the outer body (5") which is forced open by the inner body (5') when inserted into the outer body (5").

9. A vehicle jack comprising; a support leg (23) engaged on a support foot (25), a vehicle support arm (24) rotatably engaged on the support leg (23) and a screw spindle (26) operated by a winding handle (27) threaded through a nut (5) on the support leg (23), the screw spindle being engaged to a cross member (33) rotatably engaged in the support leg (23), an auxiliary part (30) being coaxially engaged with the cross member (33) and having a vehicle support plate (31) engaged to a free end thereof, wherein the auxiliary part (30) engages an end of the screw spindle when the jack is in a folded position, wherein the nut (5) comprises an outer body (5") and an interior part (5') engaged in the outer body (5") at a plurality of surface contact points, the screw spindle (26) being threadedly engaged in the interior part (5'), and wherein the auxiliary part (30) has at an end nearest to the screw spindle, two protruding lugs (34) converging towards an inner cavity, an end portion of the said screw spindle engaging the lugs (34) when the jack is in a folded position.

10. The vehicle jack as defined in claim 9, wherein the outer body (5") has a U-shaped cross section, a base with a hole therethrough, two parallel wings (2, 3) projecting up respectively from opposite sides of the base which have end edges (6) parallel to the base, two parallel longitudinal reinforcements (12) projecting up respectively from the base between the two parallel wings (2, 3), ends of the two parallel wings each having a surface (9) inclined toward a central plane of the U-shaped body, each said surface (9) having aligned cavities (10).

11. The vehicle jack as defined in claim 10, wherein the inner body (5') has two side projections (18) that form two surface areas (20), two aligned front projections (13) that each create aligned surface areas (17), and a trunco-conical reinforcement (14) protruding from an end of the inner body (5') where the aligned surface areas (17) are situated.

12. The vehicle jack as defined in claim 10, wherein the aligned cavities (10) in the outer body (5") receive, by clipping together, the two aligned projections (13) on the inner body (5'), with the aligned surface areas (17) of the inner body (5') engaged in cavities (10) of the outer body (5"), while at the same time contact is also respectively established between the two edges (6) of the outer body (5") and the two surface areas (20) of the inner body (5') and between the trunco-conical projection (13) of the inner body (5') and a forward portion (19) of the winding handle (27) when folded toward the nut (5).

13. The vehicle jack as defined in claim 9, wherein each said surface (9) is inclined in convergence towards each other, providing a narrowing or tapering towards an end of the outer body (5") which is forced open by the inner body (5') when inserted into the outer body (5").

14. The vehicle jack as defined in claim 9, wherein the two lugs (34) of the auxiliary part (30) are inclined towards an interior thereof.

15. The vehicle jack as defined in claim 9, wherein the two lugs (34) are contacted by the head of the screw spindle (26) when the jack is in a folded position.

16. The vehicle jack as defined in claim 9, wherein the two lugs (34) are contacted by an end riveted portion of the screw spindle (26) when the jack is in a folded position.

17. A vehicle jack comprising; a support leg (23) engaged on a support foot (25) a vehicle support arm (24) rotatably engaged on the support leg (23) and a screw spindle (26) operated by a winding handle (27) threaded through a nut (5) on the support leg (23), the screw spindle being engaged to a cross member (33) rotatably engaged in the support leg (23), an auxiliary part (30) being coaxially engaged with the cross member (33) and having a vehicle support plate (31) engaged to a free end thereof, wherein the auxiliary part (30) engages an end of the screw spindle when the jack is in a folded position, wherein the nut (5) comprises an outer body (5") and an interior part (5') engaged in the outer body (5") at a plurality of surface contact points, the screw spindle (26) being threadedly engaged in the interior part (5');

wherein each said surface (9) is inclined in convergence towards each other, providing a narrowing or tapering towards an end of the outer body (5") which is forced open by the inner body (5') when inserted into the outer body (5").

18. The vehicle jack as defined in claim 17, wherein the outer body (5") has a U-shaped cross section, a base with a hole therethrough, two parallel wings (2, 3) projecting up respectively from opposite sides of the base which have end edges (6) parallel to the base, two parallel longitudinal reinforcements (12) projecting up respectively from the base between the two parallel wings (2, 3), ends of the two parallel wings each having a surface (9) inclined toward a central plane of the U-shaped body, each said surface (9) having aligned cavities (10).

19. The vehicle jack as defined in claim 18, wherein the inner body (5') has two side projections (18) that form two surface areas (20), two aligned front projections (13) that each create aligned surface areas (17), and a trunco-conical reinforcement (14) protruding from an end of the inner body (5') where the aligned surface areas (17) are situated.

20. The vehicle jack as defined in claim 19, wherein the aligned cavities (10) in the outer body (5") receive, by clipping together, the two aligned projections (13) on the inner body (5'), with the aligned surface areas (17) of the inner body (5') engaged in cavities (10) of the outer body (5"), while at the same time contact is also respectively established between the two edges (6) of the outer body (5") and the two surface areas (20) of the inner body (5') and between the trunco-conical projection (13) of the inner body (5') and a forward portion (19) of the winding handle (27) when folded toward the nut (5).

21. The vehicle jack as defined in claim 17, wherein the auxiliary part (30) has at an end nearest to the screw spindle, two protruding lugs (34) converging towards an inner cavity, and end portion of the said screw spindle engaging the lugs (34) when the jack is in a folded position.

22. The vehicle jack as defined in claim 21, wherein the two lugs (34) of the auxiliary part (30) are inclined towards an interior thereof.

23. The vehicle jack as defined in claim 21, wherein the two lugs (34) are contacted by the head of the screw spindle (26) when the jack is in a folded position.

24. The vehicle jack as defined in claim 21, wherein the two lugs (34) are contacted by an end riveted portion of the screw spindle (26) when the jack is in a folded position.

* * * * *